US007059692B2

(12) United States Patent
Glenn

(10) Patent No.: US 7,059,692 B2
(45) Date of Patent: Jun. 13, 2006

(54) TOOL BOX

(76) Inventor: William F. Glenn, 2577 Elysium Ave., Eugene, OR (US) 97401

( * ) Notice: Subject to any disclaimer, the term of this patent is extended or adjusted under 35 U.S.C. 154(b) by 3 days.

(21) Appl. No.: 10/895,736

(22) Filed: Jul. 20, 2004

(65) Prior Publication Data

US 2006/0016705 A1 Jan. 26, 2006

(51) Int. Cl.
*A47B 95/02* (2006.01)

(52) U.S. Cl. ..... 312/244; 206/372

(58) Field of Classification Search ..... 206/510, 206/557, 372, 373; 312/244, 902, 287, 245, 312/352; D3/308, 309, 315
See application file for complete search history.

(56) References Cited

U.S. PATENT DOCUMENTS 4,341,304 A 7/1982 Diller
4,653,713 A 3/1987 Hamilton
4,744,613 A 5/1988 Brantingham
5,117,979 A 6/1992 Brightbill
D329,135 S 9/1992 Embree
6,786,561 B1 9/2004 Glenn

*Primary Examiner*—David T. Fidei
(74) *Attorney, Agent, or Firm*—Robert E. Howard

(57) ABSTRACT

An improved tool box adapted to be positioned onto a joist or beam. The tool box has a central passageway extending between and through its front and rear walls. At least two web cross members extend between the side walls of the central passageway. Each of the web cross members have a plurality of generally rectangular shaped cutouts positioned along a common longitudinal axis, each of the cutouts communicating with each other. Each cutout has a width that is greater than the width of that cutout located immediately above it. The cutouts form upper joist receiving raceways. A lower joist receiving raceway is formed by the first and second bottom edges of the web cross member and that portion of the side walls of the central passageway located below the bottom edges of the web cross member.

13 Claims, 3 Drawing Sheets

TOOL BOX

BACKGROUND OF THE INVENTION

The present invention relates to an improved tool box. More specifically, it relates to a tool box that can be used by subcontractors installing items in a building under construction prior to flooring being laid down.

Plumbers, for example, install water lines, drain lines, etc. prior to flooring and walls being installed in a structure. It is difficult to set down a tool box in situations where only floor joists or beams are present.

In copending application Ser. No. 10/757,617 filed Jan. 13, 2004, the present inventor describes a tool box that can be firmly positioned onto joists and beams. That tool box has front and rear end walls attached to right and left side walls, and a handle. A tiered passageway extends between the central portions of the front and rear end walls. The tiered passageway includes an upper passageway tier having a first width, a middle passageway tier having a second width, and a lower passageway tier having a third width. Right and left floor portions extend between the bottom edges of the box side walls and the bottom edges of the lower passageway tier. The third width is greater than the second width, and the second width is greater than the first width. The various widths are adapted to snugly fit over the upper portions of joists and beams of varying width.

SUMMARY OF THE INVENTION

It is an object of the present invention to provide an improved tool box that can be firmly positioned onto joists and beams in a manner similar to that described in applicant's prior application, but which is easier to construct.

The improved tool box of the present invention includes front and rear box end walls attached to right and left box side walls.

A central passageway extends between and through the front and rear walls. The central passageway is formed by right and left side walls and a ceiling extending between the tops of the sidewalls.

A right floor portion extends between the bottom edge of the right box side wall and the bottom edge of said right side wall of said central passageway;

A left floor potion extends between the bottom edge of the left box side wall and the bottom edge of said left side wall of said central passageway;

At least two web cross members extend between the side walls of the central passageway, one of the web members extending between said sidewalls adjacent the first ends thereof and a second of the web members extending between said sidewalls adjacent the second ends thereof. Each of the web cross members have a web top edge, first and second web side edges, and first and second web bottom edges. The web bottom edges are located above the bottom edges of the right and left sidewalls of said central passageway. Each of the web cross members have a plurality of generally rectangular shaped cutouts positioned along a common vertical axis, the uppermost cutout being located adjacent the web top edge and the lowermost cutout ending at the first and second web bottom edges. Each of the cutouts communicate with each other, each cutout has a width that is greater than the width of that cutout located immediately above it. The widths are selected to be substantially the same as the nominal width of a joist or beam.

The cutouts of the web cross members form upper joist receiving raceways. A lower joist receiving raceway is formed by the first and second bottom edges of the web cross members and that portion of the sidewalls of the central passageway located therebelow.

DESCRIPTION OF PREFERRED EMBODIMENTS

Figure 1:
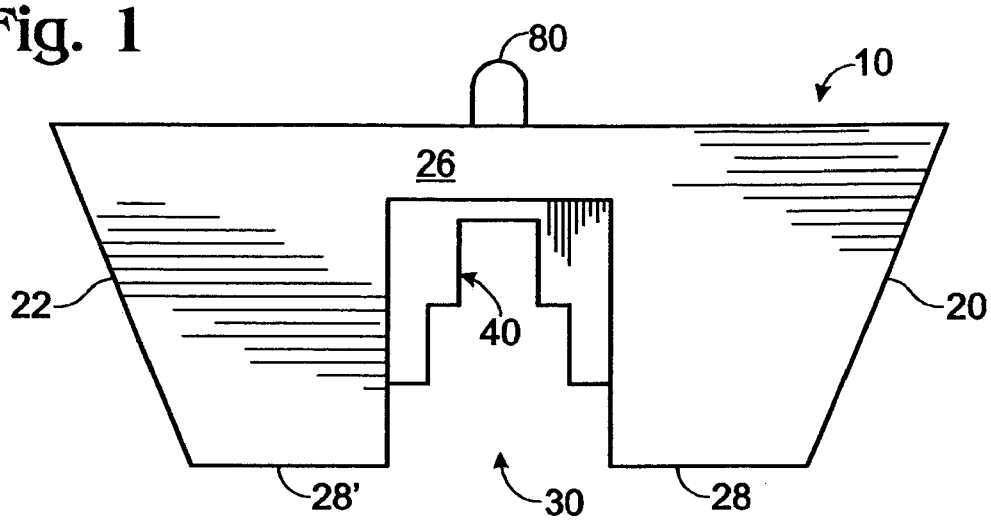
FIG. 1 is an end elevation view of the tool box of the present invention.
Figure 2:
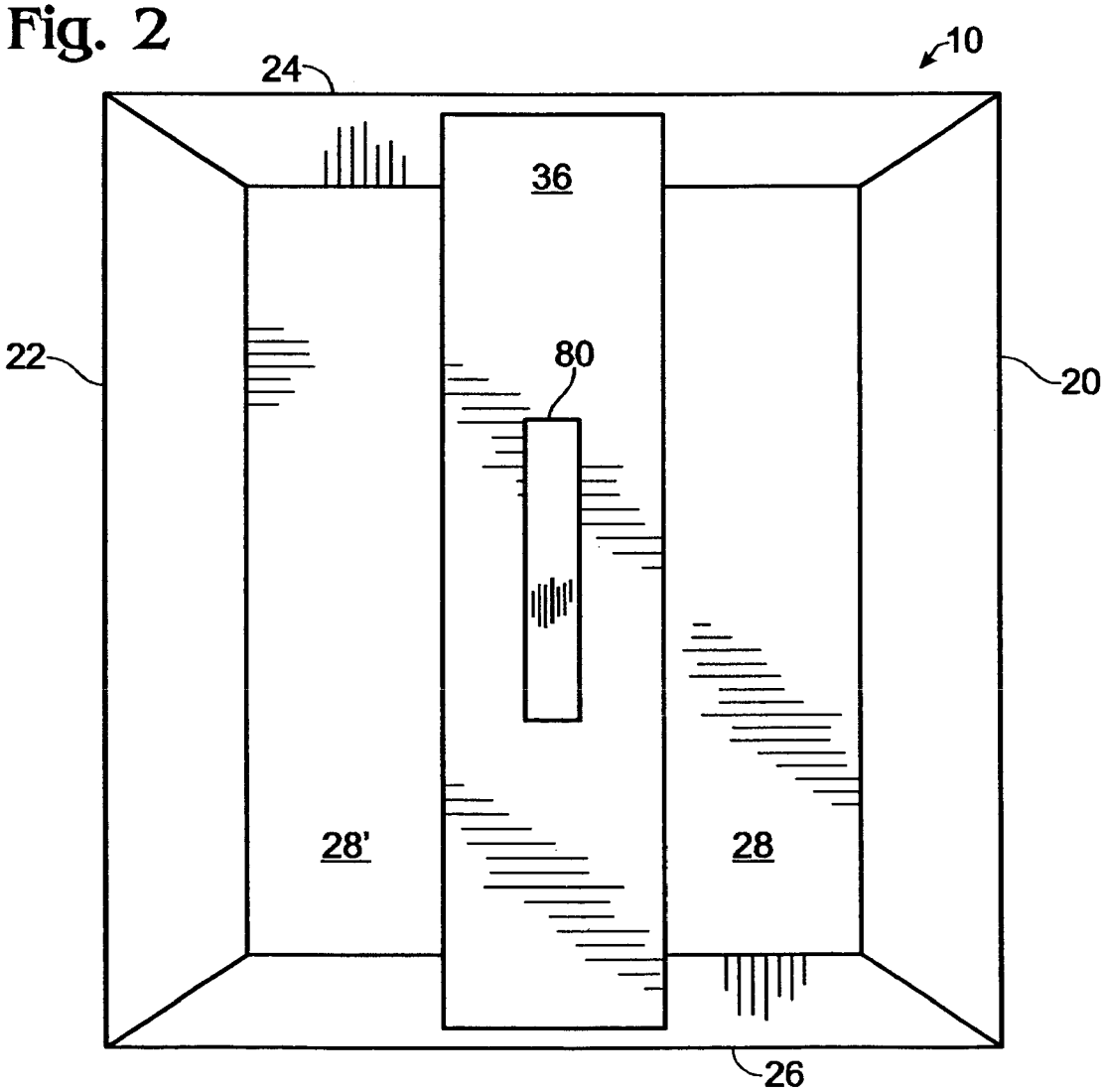
FIG. 2 is a top plan view of the tool box of the present invention.
Figure 3:
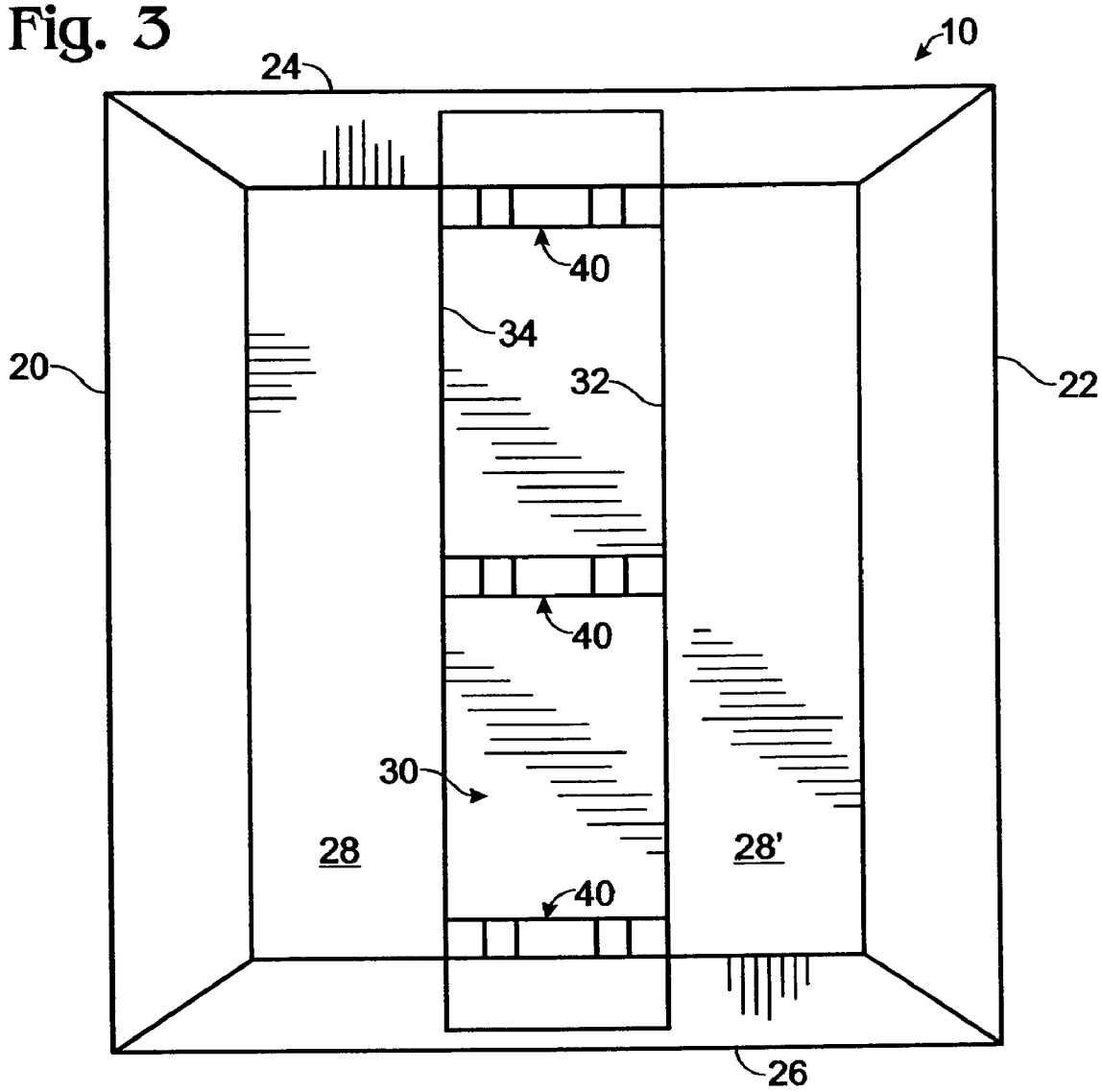
FIG. 3 is a bottom plan view of the tool box of the present invention.

The tool box 10 of the present invention has right and left sloping box side walls 20 and 22, front and rear box end walls 24 and 26, and right and left box bottom portions 28 and 28'.

Tool box 10 has a central passageway 30 extending between and through central portions of front and rear box end walls 24 and 26. Central passageway 30 is generally rectangular in cross-section, and formed by left and right side walls 32 and 34, and a ceiling 36.

Three substantially identical web cross members 40 extend between, and are attached to, left and right side walls 32, 34 and the lower surface of ceiling 36 of central passageway 30. Web cross members 40 are substantially perpendicular to left and right side walls 32 and 34. One web cross web member 40 is located adjacent each end of central passageway 30, and one web cross member 40 located substantially in the middle thereof. Although three web cross members 40 are shown as a preferred embodiment, two web cross members 40 could be employed, one adjacent each end of central passageway 30. Alternatively, more than three web cross members 40 could be employed, one adjacent each end of central passageway 30 and a plurality located in between.

Figure 4:
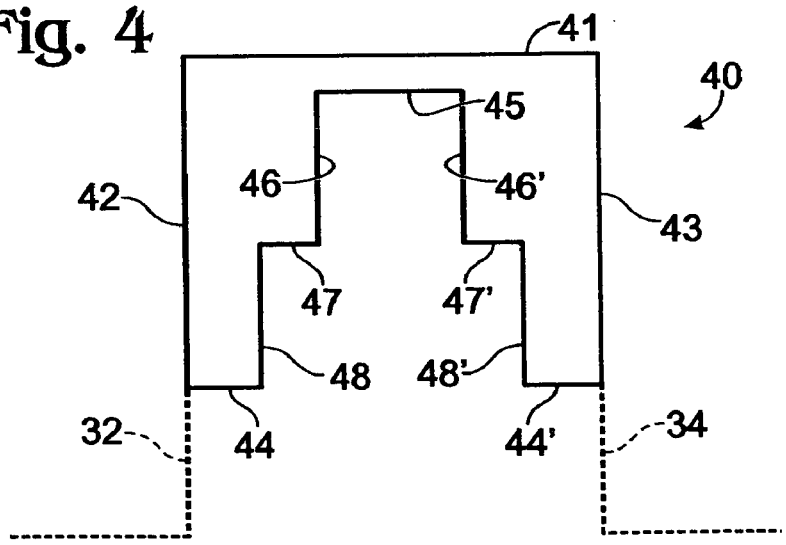
FIG. 4 is a front elevation view of one of the web cross members of the tool box of the present invention.

A single web cross member 40 is shown in FIG. 4. Web cross member 40 has a top edge 41, side edges 42 and 43, and bottom edges 44 and 44'. An upper cutout is bounded by upper edge 45 and side edges 46 and 46'. A lower cutout is bounded by upper edges 47 and 47', and side edges 48 and 48'. Although two cutouts are show in the drawings as a preferred embodiment, more than two cutouts may be formed in the web cross members 40.

An upper joist receiving raceway is formed by the upper cutouts of the web cross members 40. A middle joist receiving raceway is formed by the lower cutouts of the web cross members 40. A lower joist receiving raceway is formed by the bottom edges 44, 44' of web cross member 40 and that portion of side walls 32 and 34 located below bottom edges 44, 44'. Herein whenever the phrase "joist receiving raceway" is used, it is intended to mean that the raceway could receive either joists or beams.

The width of the lower joist receiving raceway is greater than the width of the middle joist receiving raceway, and the width of the middle joist receiving raceway is greater than the width of the upper joist receiving raceway. The three widths are selected to fit over joists and beams of nominal widths commonly encountered in construction. Preferably, the first width would be about 1⅞ inches to snugly fit over the upper portion of a joist having a nominal width of two inches, the second width would be about 2½ inches to snugly fit over the upper portion of a joist having a nominal width of three inches, and the third width would be about 3⅝ inches to snugly fit over the upper portion of a beam having a nominal width of four inches.

Figure 5:
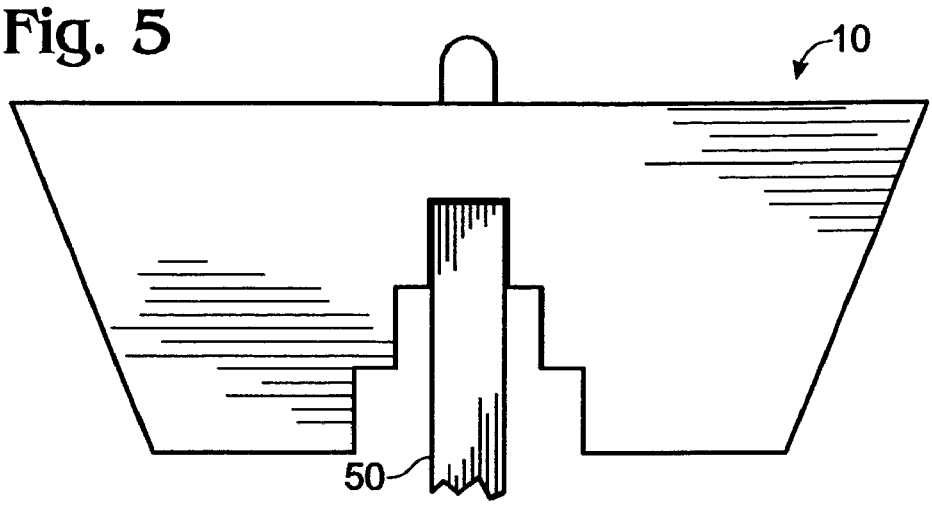
FIG. 5 is an end elevation view of the tool box of the present invention shown positioned on a joist having a first width.
Figure 6:
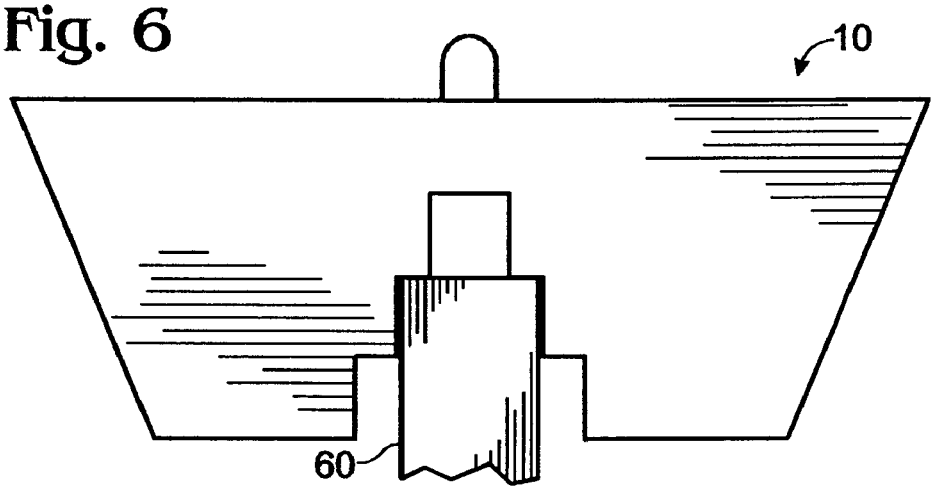
FIG. 6 is an end elevation view of the tool box of the present invention shown positioned on a joist having a second width.
Figure 7:
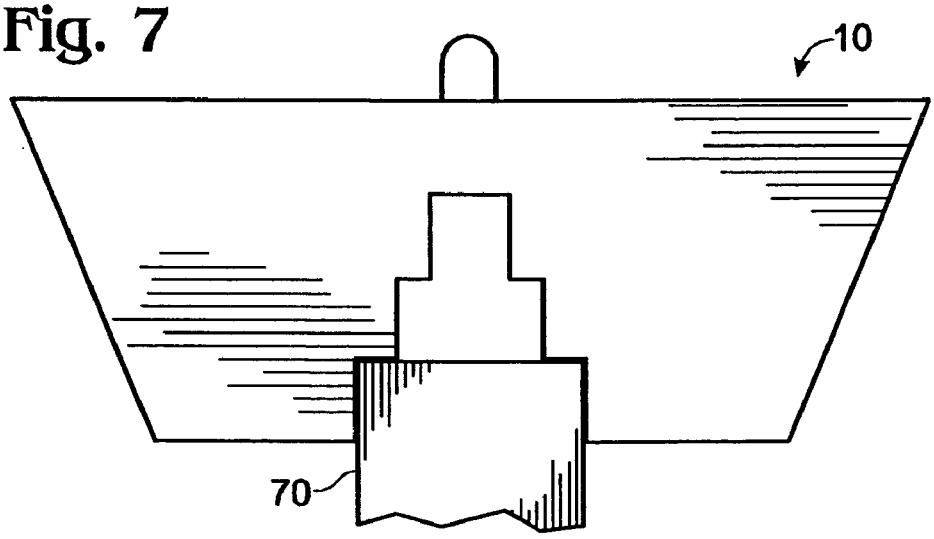
FIG. 7 is an end elevation view of the tool box of the present invention shown positioned on a beam having a third width.

FIGS. 5–7 illustrate the tool box 10 positioned on joists or beams of three different widths. In FIG. 5, the upper joist receiving raceway of tool box 10 is snugly positioned onto the upper portion of joist 50. In FIG. 6, the middle joist receiving raceway of tool box 10 is snugly positioned onto the upper portion of joist 60. In FIG. 7, the lower joist receiving raceway of tool box 10 is snugly positioned onto the upper portion of beam 70.

A handle 80 is attached to a central portion of the outer surface of ceiling 33 of central passageway 30.

Tool box 10 may be made of separate elements made of wood, metal, plastic, etc., that are attached together by any suitable means, such as gluing, welding or the use of threaded or unthreaded fasteners. Preferably, tool box 10 is made of plastic molded wholly or substantially as a single piece. Herein, whenever the elements of tool box 10 are described as being "attached" to one another it is intended to include attaching separately made elements together or molding all, or substantially all, of the elements together as a single integral structure.

Although the tool box 10 has been described as employing web cross members 40 that provide for three joist receiving raceways, additional cutouts could be made to web cross member 40 to provide for more than three joist receiving raceways.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An improved tool box adapted to be positioned onto a joist or beam comprising:

front and rear box end walls attached to right and left box side walls, said right and left box side walls each having a top edge and a bottom edge;

a central passageway extending between and through said front and rear box end walls, said central passageway having right and left side walls, each of said right and left side walls of said central passageway having a top edge, a bottom edge, and first and second ends, said central passageway having a ceiling extending between the top edges of said right and left sidewalls of said central passageway;

a right floor potion extending between the bottom edge of said right box side wall and the bottom edge of said right side wall of said central passageway;

a left floor potion extending between the bottom edge of said left box side wall and the bottom edge of said left side wall of said central passageway;

at least two web cross members extending between said right and left side walls of said central passageway, a first of said web members extending between said right and left sidewalls of said central passageway adjacent the front box end wall and a second of said web members extending between said right and left sidewalls of said central passageway adjacent the rear box end wall;

each of said web cross members having a web top edge, first and second web side edges, and first and second web bottom edges which are located above the bottom edges of said right and left sidewalls of said central passageway, each of said web cross members having a plurality of generally rectangular shaped cutouts positioned along a common vertical axis including an uppermost cutout being located adjacent said web top edge and a lowermost cutout being located adjacent said first and second web bottom edges, each of said plurality of generally rectangular shaped cutouts communicating with each other, each of said plurality of generally rectangular shaped cutouts having a width that is greater than the width of the cutout located immediately above it;

said uppermost cutout of each of said web cross members forming an upper joist receiving raceway; and said first and second bottom edges of each of said web cross members and that portion of said right and left sidewalls of said central passageway located below said first and second bottom edges of each of said web cross members forming a lower joist receiving raceway.

2. The tool box of claim 1 wherein said right and left box side walls slope outwardly from their bottom edges to their top edges.

3. The tool box of claim 1 including a handle attached to a central portion of the outer surface of said ceiling of said central passageway.

4. The tool box of claim 1 wherein each of said joist receiving raceways are adapted to snugly receive the upper portion of a joist or beam having a nominal width that is substantially the same as the width of said raceway.

5. An improved tool box adapted to be positioned onto a joist or beam comprising:

front and rear box end walls attached to right and left box side walls, said right and left box side walls each having a top edge and a bottom edge;

a central passageway extending between and through said front and rear box end walls, said central passageway having right and left side walls, each of said right and left side walls of said central passageway having a top edge, a bottom edge, and first and second ends, said central passageway having a ceiling extending between the top edges of said right and left sidewalls of said central passageway;

a right floor portion extending between the bottom edge of said right box side wall and the bottom edge of said right side wall of said central passageway;

a left floor potion extending between the bottom edge of said left box side wall and the bottom edge of said left side wall of said central passageway;

at least two web cross members extending between said right and left side walls of said central passageway, a first of said web members extending between said right and left sidewalls of said central passageway adjacent the front box end wall and a second of said web members extending between said right and left sidewalls of said central passageway adjacent the rear box end wall;

each of said web cross members having a web top edge, first and second web side edges, and first and second web bottom edges which are located above the bottom edges of said right and left sidewalls of said central passageway, each of said web cross members having an upper cutout located adjacent said web top edge of said upper cutout being bounded by an upper cutout upper edge and upper cutout side edges, each of said web cross members having a lower cutout located below said upper cutout and in communication therewith, said lower cutout being bounded by lower cutout upper edges and lower cutout side edges, the distance between said upper cutout side edges being less than the distance between said lower cutout side edges;

said upper cutout of each of said web cross members forming an upper joist receiving raceway, said lower cutout of each of said web cross members forming a middle joist receiving raceway, and said first and second bottom edges of each of said web cross member and that portion of said right and left sidewalls of said central passageway located below said first and second bottom edges forming a lower joist receiving raceway.

6. The tool box of claim 5 wherein said upper joist receiving raceway is adapted to snugly receive the upper portion of a joist having a nominal width of two inches, said middle joist receiving raceway is adapted to snugly receive the upper portion of a joist having a nominal width of three inches, and said lower joist receiving raceway is adapted to snugly receive the upper portion of a beam having a nominal width of four inches.

7. The tool box of claim 5 wherein each of said web cross members are substantially perpendicular to said right and left side walls of said central passageway.

8. The tool box of claim 7 including at least a third web cross member extending between said right and left sidewalls of said central passageway at a location between said first and second web cross members.

9. The tool box of claim 5 wherein said right and left box side walls slope outwardly from their bottom edges to their top edges.

10. The tool box of claim 5 including a handle attached to a central portion of the outer surface of said ceiling of said central passageway.

11. The tool box of claim 5 wherein said upper cutout and said lower cutout are each generally rectangular in shape.

12. The tool box of claim 1 wherein each of said web cross members are substantially perpendicular to said right and left side walls of said central passageway.

13. The tool box of claim 12 including at least a third web cross member extending between said right and left sidewalls of said central passageway at a location between said first and second web cross members.

* * * * *